United States Patent [19]

Mathers et al.

[11] Patent Number: 5,077,452

[45] Date of Patent: Dec. 31, 1991

[54] DOORBELL BLOCK

[76] Inventors: Lee F. Mathers; Janice B. Mathers, both of 1530 Santa Anita Dr., Lynn Haven, Fla. 32444

[21] Appl. No.: 570,004

[22] Filed: Aug. 20, 1990

[51] Int. Cl.[5] ..... H01R 13/44; H01H 3/20

[52] U.S. Cl. ..... 200/43.01; 200/308; 200/43.220; 200/43.190; 174/66; 220/3.8; 220/241; 70/DIG. 30; 70/DIG. 34

[58] Field of Search ..... 200/43.01, 42.22, 43.19, 200/43.21, 43.16, 308; 220/241, 242, 3.8; 174/66, 67; 70/DIG. 30, DIG. 34, 169; 292/24, 31, 121

[56] References Cited

U.S. PATENT DOCUMENTS

| | | | |
|---|---|---|---|
| 3,629,529 | 12/1971 | Dietz | 200/43.19 |
| 3,734,335 | 5/1973 | Lincoln | 70/DIG. 34 |
| 4,102,471 | 7/1978 | Lore et al. | 220/3.8 |
| 4,506,120 | 3/1985 | Fleischman | 200/43.19 |
| 4,541,538 | 9/1985 | Swetnam | 220/3.8 |
| 4,607,900 | 8/1986 | Andrews et al. | 200/43.22 |
| 4,896,784 | 1/1990 | Heath | 220/3.8 X |

FOREIGN PATENT DOCUMENTS

| | | | |
|---|---|---|---|
| 2438517 | 2/1976 | Fed. Rep. of Germany | 200/43.01 |

*Primary Examiner*—Ernest G. Cusick
*Attorney, Agent, or Firm*—Cort Flint

[57] ABSTRACT

A doorbell block (A) is disclosed which includes a cover (18) and a pair of movable sidewalls (26, 28) which are biased towards each other to grippingly engage a doorbell housing (14) so that a face plate (20) of the cover prevents actuation of the door bell button (16) and unwanted rings. Tab openings (E) allow the user to spread the sidewalls apart for installation and removal. A biasing spring (C) urges the sidewalls together to grippingly engage the doorbell housing to retain the cover in place.

15 Claims, 2 Drawing Sheets

DOORBELL BLOCK

BACKGROUND OF THE INVENTION

The invention relates to a device for blocking a doorbell to prevent unwanted rings.

In many instances, it is desirable to prevent unwanted doorbell rings. For example, families with babies, shift workers, and late sleepers and nappers, often desire to not be disturbed by doorbell rings. U.S. Pat. No. DES. 287,704 discloses a combined housing for a doorbell switch, signal system, and a message cabinet. Apparently, electricals are provided in the housing which enable the doorbell to be disabled. A light flashes to indicate that the doorbell has been disabled. U.S. Pat. No. 3,964,058 discloses a doorbell system for a residence wherein the resident may establish an illuminated signal that the resident does not wish to be disturbed except for an emergency. These types of systems are not entirely satisfactory for preventing unwanted doorbell rings since they require electrical circuits and connections and are unattractive to a large part of the market due to complicated installation and other requirements.

Accordingly, an object of the invention is to provide a simple and economical, yet effective, device for preventing unwanted doorbell rings.

Another object of the invention is to provide a device for preventing unwanted doorbell rings which is generally universal and operates with a wide variety of doorbells.

Another object of the invention is to provide a device having universal fit for preventing unwanted doorbell rings which attaches to the doorbell and prevents the button from being pushed that may be installed and removed quickly and conveniently by a resident.

SUMMARY OF THE INVENTION

The above objectives are accomplished according to the present invention by providing a doorbell block which includes a cover that attaches to a doorbell housing to prevent actuation of the doorbell button. The cover includes a face plate which may display a personal message and flexible sidewalls which are biased so that the cover grips the edges of the doorbell housing in a reliable manner to hold the doorbell block in place. Expediently, the flexible sidewalls are provided by rigid plates which are biased towards each other having a longitudinal clamping edge so that the sidewalls may be spread apart more or less to accommodate different size doorbell housings. A finger tab opening included in the sidewalls provides for convenient spreading apart and releasing of the sidewalls for installation and removal.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
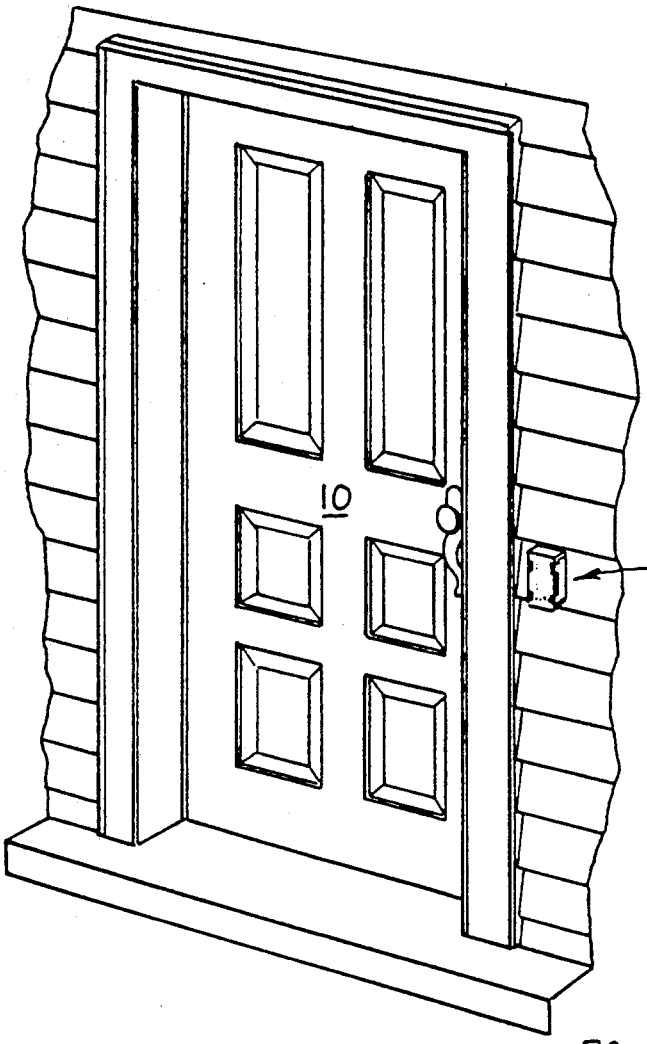
FIG. 1 is a perspective view illustrating a door of a residence having a doorbell protected by a doorbell block in accordance with the present invention.

Referring now in more detail to the drawings, as can best be seen in FIG. 1, an entrance door 10 of a residence or the like dwelling, is illustrated which includes a doorbell, designated generally at 12, which is covered with a doorbell block, designated generally as A, constructed in accordance with the invention. Doorbell 12 typically includes a doorbell housing 14 and a doorbell button 16 which causes a bell or other device to produce an audible signal inside the dwelling when actuated. In accordance with the present invention, doorbell block device A is installed over the doorbell button 16 to prevent actuation of the doorbell and unwanted ringing.

Figure 4:
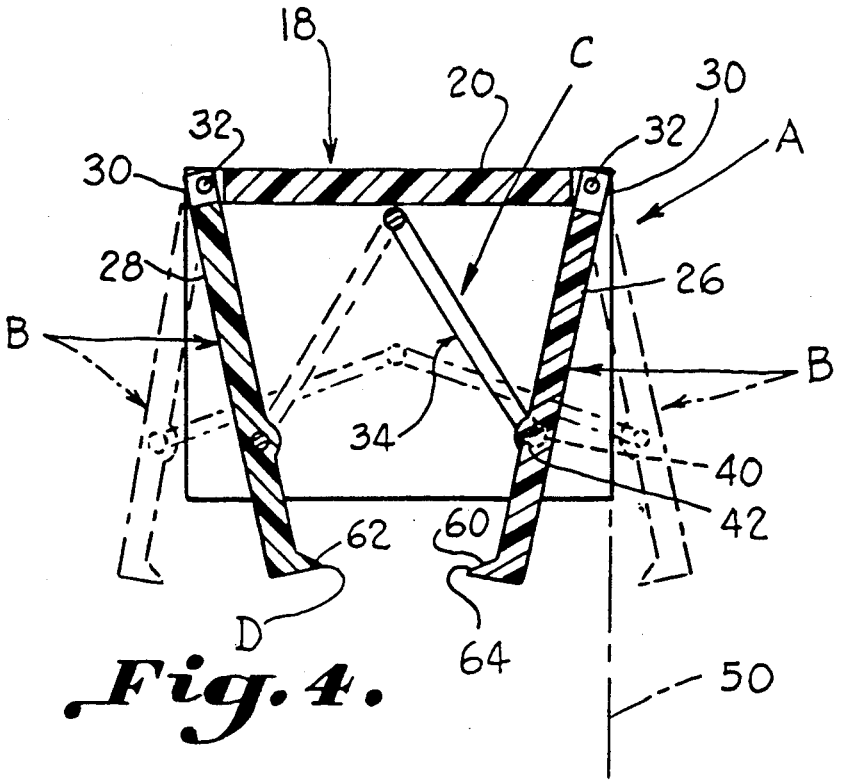
FIG. 4 is a sectional view taken along section line 4—4 of FIG. 3.
Figure 3:
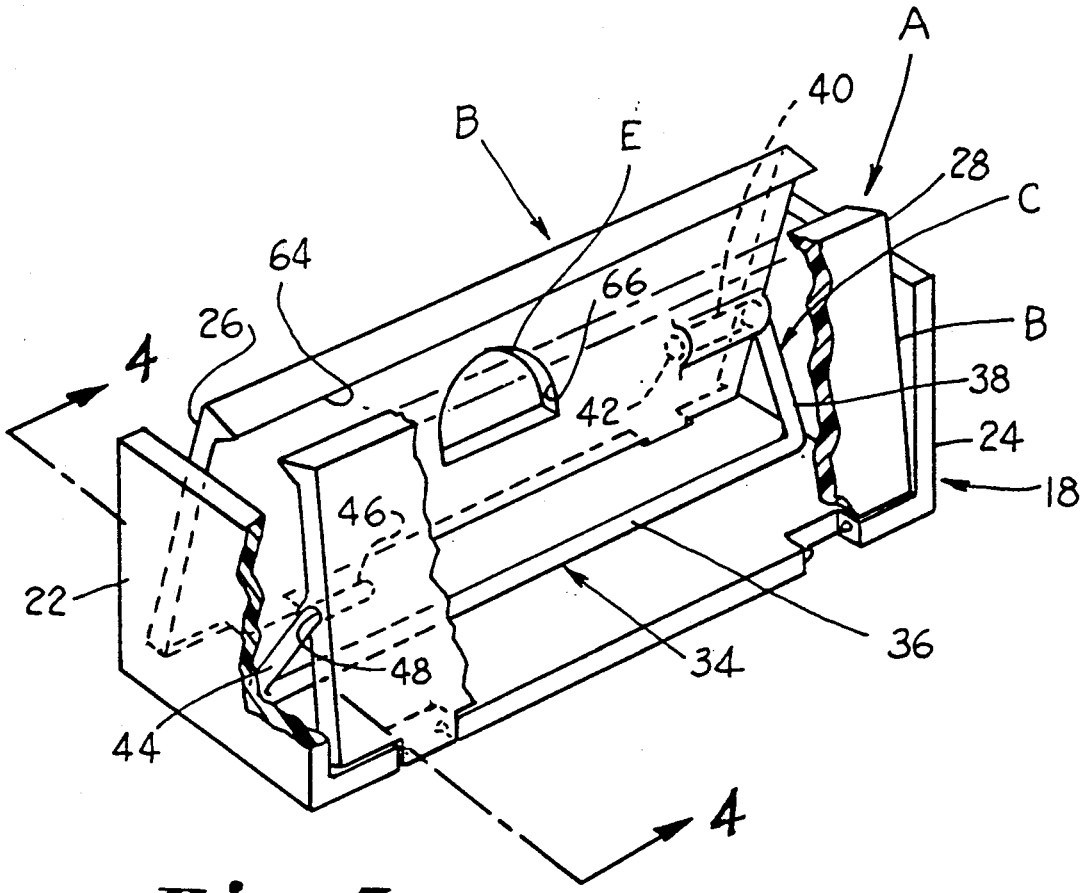
FIG. 3 is a left-hand bottom perspective view of a doorbell block constructed according to the invention with parts cut away.

As can best be seen in FIGS. 3 and 4, doorbell block A includes a cover, designated generally as 18, having a front face plate 20 and spaced end walls 22 and 24. End walls 22 and 24 may be eliminated, if needed, in accordance with the invention in order to allow the doorbell block to be installed over a wider variety of doorbell housings. Movable sidewall means B, carried by cover 18, move sidewards towards and away from each other to grippingly engage doorbell housing 14 and clamp the doorbell block over doorbell button 16. As illustrated, movable sidewall means B includes a first movable sidewall 26 and a second movable sidewall 28 which are pivotably carried by cover 18. For this purpose, each sidewall may include a pair of tabs 30 pivotably attached to cover 18 by means of pivots 32. The pivot 32 is illustrated as being carried by cover 18, but may be carried by the sidewalls just as well and received in a corresponding opening formed in cover 18. Biasing means C is provided which biases sidewalls 28 and 26 towards each other. As illustrated, biasing means C includes a torsion spring 34 interconnecting sidewalls 26 and 28 to urge them towards each other. When the sidewalls are spread apart, a biasing force is applied to the sidewalls that urges them towards each other to grippingly clamp the doorbell housing. Torsion spring 34 includes an elongated leg 36 which extends along the longitudinal axis of face plate 20. Leg 36 terminates in a leg 38 which extends towards sidewall 26 and terminates in an attachment leg 40 received in an opening 42 received in sidewall 26. The opposite end of elongated leg 36 terminates in a leg 44 which terminates in an attachment leg 46 received in an opening 48 formed in sidewall 28. It is to be understood, of course, that torsion spring 34 may be attached in other ways to the movable members of the doorbell block, and that other forms of springs and biasing means may also be utilized without departing from the spirit of the present invention.

As can best be seen in FIG. 4, sidewalls 26 and 28 may move sidewards on either side of plane 50 in which the edges of face plate 20 lie in order to accommodate a wide variety of doorbell sizes and configurations. Clamping means D is carried at the free end of each sidewall 26 and 28 to clamp against the side edges, for example 14*a* and 14*b* of the doorbell housing. For this purpose, clamping means D is provided in the form of inward projections 60 and 62 which extend inwardly and form a longitudinal edge 64 along the length of sidewalls 26 and 28 to effectively grip the edges of the doorbell housing.

Figure 2:
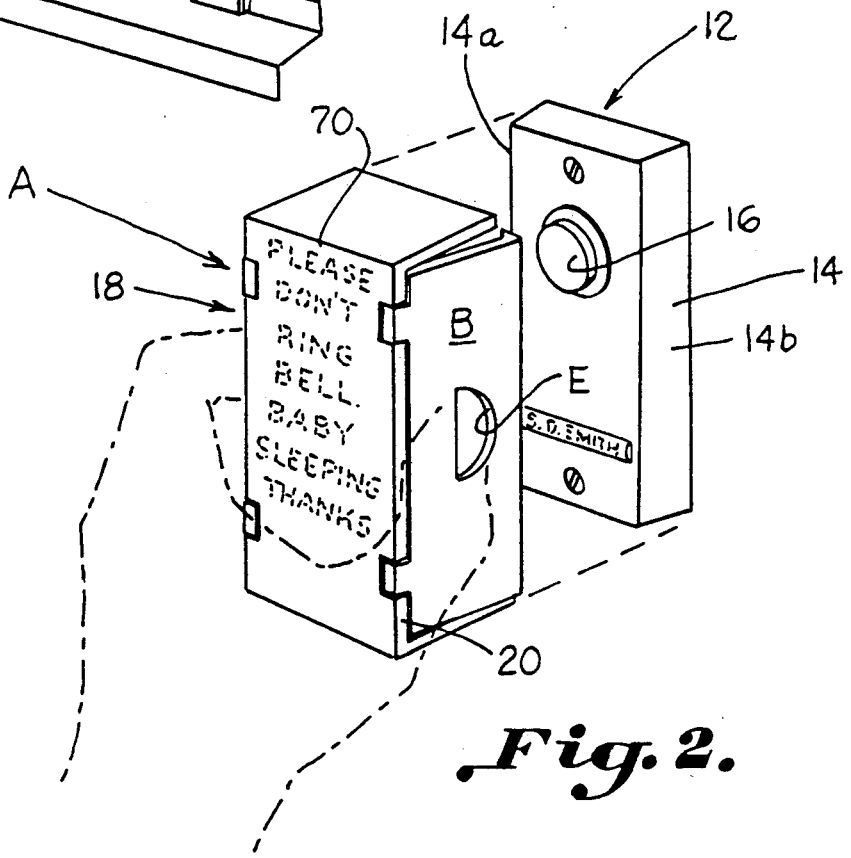
FIG. 2 is a perspective view illustrating a doorbell block constructed in accordance with the invention being installed and removed from a doorbell.

As can best be seen in FIGS. 2 and 3, finger engaging means E is illustrated for finger engagement and movement of the sidewalls. Finger engaging means E includes a finger tab opening 66 formed in sidewall 26 and in sidewall 28. The fingers may be inserted in the tab opening to spread the sidewalls apart to install the doorbell block as well as to spread the sides apart to remove the doorbell block, if necessary.

Face plate 20 provides a surface for a message which may be left by the residents. For this purpose, display means may be provided by a transparent pocket (not shown) may be attached to face plate 20 in which a message ma be easily enveloped and seen. Alternately, decals or pressure sensitive adhesive stickers 70 may be used to display messages on face plate 20.

Thus, it can be seen that an advantageous construction can be had for a doorbell block in accordance with the invention which may be easily installed and removed from the doorbell by the resident to prevent unwanted ringings.

While a preferred embodiment of the invention has been described using specific terms, such description is for illustrative purposes only, and it is to be understood that changes and variations may be made without departing from the spirit or scope of the following claims.

What is claimed is:

1. A doorbell block for covering a doorbell button to prevent unwanted ringings within a dwelling comprising:

a cover having a face plate;

a pair of movable sidewalls carried by said cover;

biasing means for biasing said movable sidewalls towards each other; and finger engaging means carried by said sidewalls for engagement by fingers of a resident of said dwelling to engage said sidewalls for sidewards movement during installing and removal of said cover.

2. The device of claim 1 including free edges defined at the termination of said movable sidewalls, and clamping means carried by said free edges for gripping against said doorbell housing.

3. The device of claim 2 wherein said clamping means comprises an inwardly extending projection carried by each of said sidewalls terminating in a generally longitudinal edge extending generally along the length of said sidewalls for projecting and gripping against said doorbell housing to maintain said cover in place.

4. The device of claim 1 wherein said face plate includes a surface which accommodates a written message from said resident.

5. The device of claim 1 wherein said finger engaging means comprises finger tab openings formed in said sidewalls for receiving portions of said fingers of said residents to allow said resident to move said sidewalls away from each other for installation and removal of said cover.

6. The device of claim 1 wherein said sidewalls are pivotably carried by said cover.

7. The device of claim 6 wherein said sidewalls extend from said face plate and terminate in a free edge which provides a clamping surface for clamping said sidewalls to said doorbell housing.

8. The device of claim 1 wherein said biasing means comprises a torsion spring having an elongated leg carried longitudinally near an inside surface of said cover, a first attachment leg carried by said elongated leg connected to said first sidewall, a second attachment leg carried by said elongated leg connected to said second sidewall so that said first and second sidewalls are urged towards each other.

9. A doorbell block for covering a doorbell button to prevent unwanted ringings within a dwelling comprising:

an elongated cover having a face plate adapted for receiving a written message from a resident;

a first elongated pivotal sidewall pivotably carried by said cover;

a second elongated pivotal sidewall pivotably carried by said cover;

biasing means interconnecting said first and second sidewalls to urge said sidewalls towards each other; and clamping means provided by free edges of said sidewalls for grippingly engaging said doorbell housing.

10. The device of claim 9 wherein clamping means includes a longitudinal free edge of said pivotal sidewalls.

11. The device of claim 9 wherein said clamping means comprises an inwardly extending projection carried by each of said sidewalls terminating in a generally longitudinal edge extending generally along the length of said sidewalls for projecting and gripping against said doorbell housing to maintain said cover in place.

12. The device of claim 9 wherein said face plate includes means for displaying a written message from said resident.

13. The device of claim 9 including:

finger engaging means carried by said first and second sidewalls for receiving said fingers of said resident to allow said resident to spread said sidewalls apart for installing and removing said cover over said doorbell housing.

14. The device of claim 13 wherein said finger engaging means comprises finger tab openings formed in said sidewalls for receiving portions of said fingers of said residents to allow said resident to move said sidewalls away from each other for installation and removal of said cover.

15. The device of claim 9 wherein said biasing means comprises a torsion spring having an elongated leg carried longitudinally near an inside surface of said cover, a first attachment leg carried by said elongated leg connected to said first sidewall, a second attachment leg carried by said elongated leg connected to said second sidewall so that said first and second sidewalls are pivotally urged towards each other.

* * * * *